United States Patent [19]

Rainey

[11] Patent Number: 4,483,491

[45] Date of Patent: Nov. 20, 1984

[54] TOWEL OR TISSUE HOLDER

[76] Inventor: James R. Rainey, 3825 N.W. 29, Oklahoma City, Okla. 73107

[21] Appl. No.: 487,973

[22] Filed: Apr. 25, 1983

[51] Int. Cl.[3] ..... B65H 19/00; B65H 49/00

[52] U.S. Cl. ..... 242/55.2; 242/129.6

[58] Field of Search ..... 242/55.2, 55.3, 55.53, 242/129.5, 129.6, 129.62; 225/46, 65, 66; D6/96, 97; 312/38–40

[56] References Cited

U.S. PATENT DOCUMENTS

| | | | |
|---|---|---|---|
| 438,567 | 10/1890 | Wheeler | 242/55.2 |
| 1,104,284 | 7/1914 | Wood | 242/55.2 |
| 1,432,194 | 10/1922 | Liddell | 242/55.2 |
| 2,281,032 | 4/1942 | Galena | 242/55.2 |
| 2,369,970 | 2/1945 | McClearen | 242/55.2 |

*Primary Examiner*—Leonard D. Christian

[57] ABSTRACT

This invention is a dispensing holder for rolls of paper toweling or tissue, including a wall-mountable frame, and a removable roll spindle supported at its ends in arcuate grooves of the frame, and a shelf on the frame, for holding other objects conveniently thereupon.

1 Claim, 4 Drawing Figures

TOWEL OR TISSUE HOLDER

This invention relates generally to holders of rolled sheet materials. More specifically, it relates to holders used for storage of rolled paper toweling or tissue material, and from which it may be dispensed in torn off, small sections, as needed.

It is well known that numerous holders have been designed in the past, for the storage and dispensing of rolled paper toweling and tissue, each of which has some particular advantage for its use. However, there has still remained a need, in all of them, for a more ideal means of supporting a spindle of the roll upon the holder frame, so that it is easier to remove for reloading, when needed, but which will be firmly held in place when the end of the roll paper is pulled and torn off.

Accordingly, it is a principal object of the present invention to provide a towel or tissue holder, which is unique in the way that the ends of the spindle are received and supported upon the holder frame.

Another object is to provide a towel or tissue holder, wherein the paper may be pulled either from the top or bottom of the roll.

Yet another object is to provide a towel or tissue holder, that is mountable against a vertical wall, and which includes a shelf, upon which various bottles or containers of different materials may be conveniently stored, for being readily handy.

Other objects are to provide a towel or tissue holder, which is simple in design, inexpensive to manufacture, rugged in construction, easy to use, and efficient in operation.

These, and other objects, will be readily evident, upon a study of the following specification, and the accompanying drawing, wherein.

Figure 1:
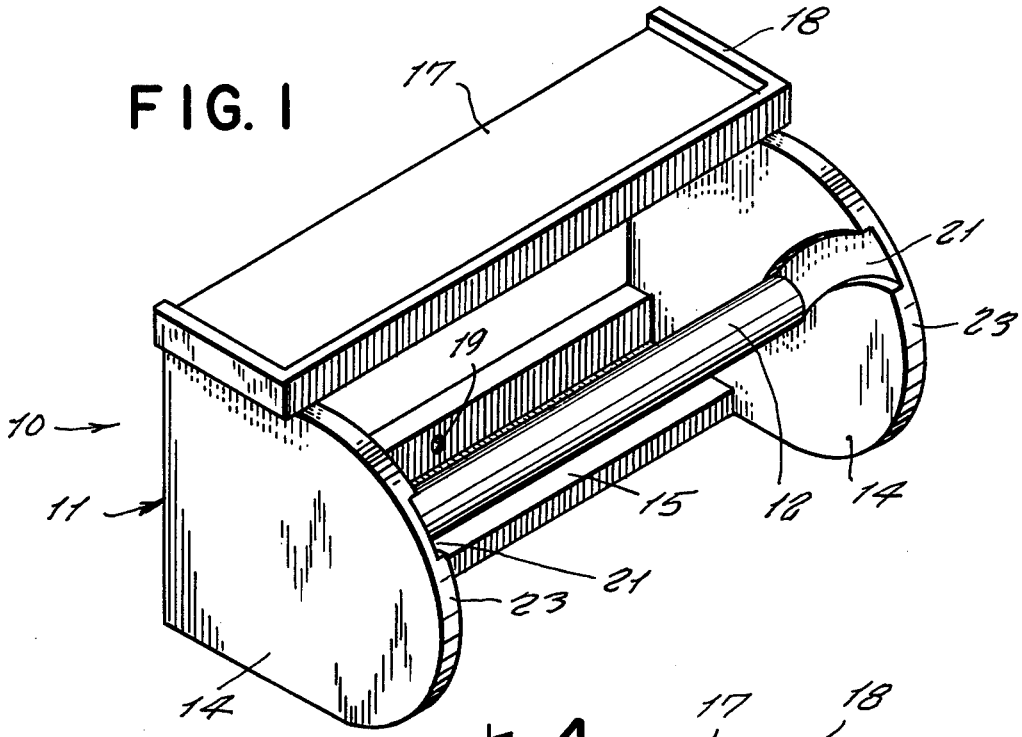
FIG. 1 is a perspective view of the embodiment of the invention.
Figure 2:
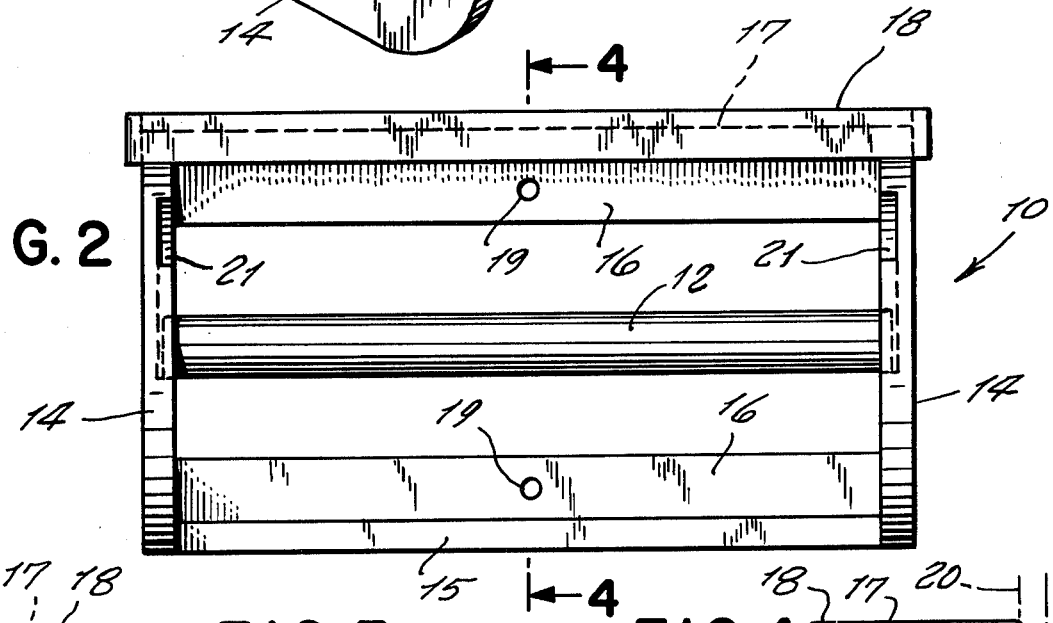
FIG. 2 is a front elevational view of the embodiment of the invention.
Figure 3:
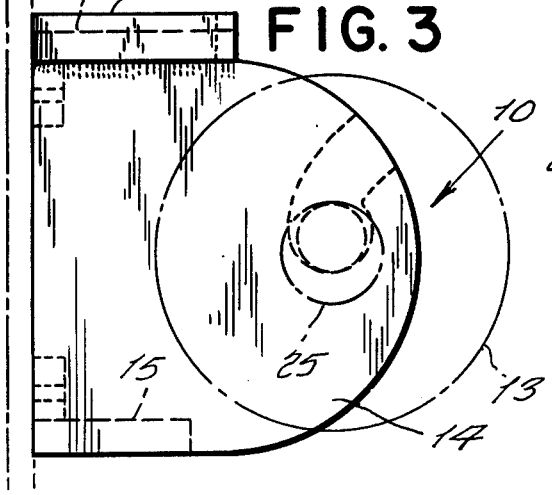
FIG. 3 is a side elevational view of the embodiment of the invention, taken from the left side of FIG. 2 (dot-dash line represents a wall)
Figure 4:
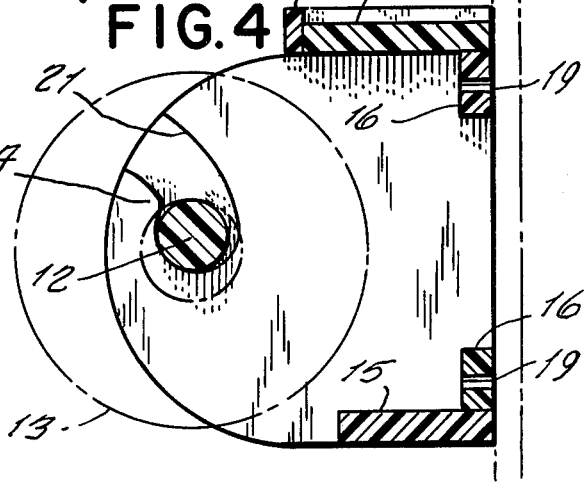
FIG. 4 is a cross-sectional view, taken along lines 4—4 of FIG. 2 (dot-dash line represents a wall).

Referring now to the drawing in greater detail, the reference numeral 10 represents a towel or tissue holder, according to the present invention, wherein there is a holder frame 11, that is permanently mountable against a wall, and a spindle 12, that is removably receivable upon the frame, for support of a paper toweling or tissue roll 13 thereupon. The holder frame and the spindle may be made of any suitable material, such as either hardwood or a rigid plastic, that may be either transparent, or in any of various colors, so as to harmonize with the decor of a room.

The holder frame includes a pair of parallel, spaced-apart side panels 14, that are rigidly affixed to opposite ends of a horizontal bottom panel 15, and a pair of rear braces 16 placed therebetween. Another horizontal panel, placed across the top thereof, forms a shelf 17. A raised bead 18 extends around a front end and side edges of the shelf, in order to prevent objects, placed upon the shelf, from falling off. Each rear brace includes a hole 19 at its center, for receiving a screw or other fastener, for securement to the wall 20. The sides 21 of the two side panels, facing each other, each include a shallow groove 22 formed therein, for supporting the spindle therebetween. Each groove is arcuate-shaped; its upper portion extending downwardly in a rearward direction from a rounded front edge 23 of the side panel, and a lower portion of the groove continues extending downwardly, but in a slightly forwardly direction, in order to form a rearwardly projecting corner 24 therebetween, along the groove front edge. The groove lower portion is made slightly wider than the upper portion, so as to serve as a comfortable seat, in which the spindle end can rest or rotate.

In operative use, a roll of paper is fitted on the spindle, by inserting the spindle through the central hole 25 of the roll, and then sliding the spindle ends into the grooves of the frame. The device is now ready for use. It is to be noted, that, while the paper roll remains still a full size, before excessive portions are torn off therefrom, it serves to hide from view any object that may be placed upon the bottom panel 15, which thus can serve as a secret shelf. The holder may be manufactured in different sizes, for either paper toweling or bathroom tissue, or else be made up in sets for both.

It is to be noted, that the spindle will not pop out of the grooves when the paper is pulled, for unwinding a portion of it from the roll, the spindle remaining in the bottom of the grooves, because of the rearwardly projecting corners 24, even if the paper is pulled in a slightly upwardly direction. To replace the paper roll, simply lift the spindle and it will easily travel out the grooves.

While various changes may be made in the detail construction, it is understood that such changes will be within the spirit and scope of the present invention, as is defined by the appended claims.

What I claim as new, is:

1. A towel or tissue holder, comprising, in combination, a frame and a spindle removably receivable upon said frame; said frame comprising a pair of spaced-apart, parallel side panels each having a rounded front edge, a transverse panel mounted across the top of both said side panels forming a top shelf, a pair or rear braces between said side panels having mounting holes for securing said holder to a room wall, a shallow groove on facing sides of said pair of side panels for supporting said spindle therebetween, opposite ends of said spindle being slidably received and supported in said grooves, a replacable roll of paper being received on said spindle, each said groove opening out on a rounded front edge of said side panel and extending arcuately rearwardly and downwardly, and including a rearwardly projecting corner formed therealong, and having a horizontal bottom panel comprising a secret shelf behind said roll of paper.

* * * * *